United States Patent [19]

Borzym et al.

[11] 4,031,792

[45] June 28, 1977

[54] HAMMER RAM PRESS

[75] Inventors: Alexander Borzym, Dearborn; John J. Borzym, Birmingham, both of Mich.

[73] Assignee: Alpha Industries, Inc., Detroit, Mich.

[22] Filed: July 12, 1976

[21] Appl. No.: 704,344

[52] U.S. Cl. ..... 83/601; 83/643; 83/632; 83/627; 83/605

[51] Int. Cl.[2] ..... B26D 5/14

[58] Field of Search ..... 83/597, 628, 602, 604, 83/601, 605, 630, 632, 643, 627; 72/450; 74/43; 100/285

[56] References Cited

UNITED STATES PATENTS

| | | | |
|---|---|---|---|
| 3,771,403 | 11/1973 | Meyer | 83/643 |
| 3,780,610 | 12/1973 | Zadow | 83/643 |
| 3,817,139 | 6/1974 | Desai et al. | 83/632 |

*Primary Examiner*—Donald R. Schran
*Attorney, Agent, or Firm*—Thomas N. Young

[57] ABSTRACT

A press adapted to operate dies such as tubing cutoff dies through a lightweight ram mounted on a parallelogram linkage for oscillating motion rather than for the usual reciprocating motion on a slide. The ram linkage is operated through a crankshaft and connecting rod by a motor, clutch, brake and flywheel. The machine is compact and uses radial bearings rather than slide bearings to guide the ram. The crankshaft and drive mechanism for the ram linkage is conveniently and accessibly located.

4 Claims, 6 Drawing Figures

HAMMER RAM PRESS

INTRODUCTION

This invention relates to presses and particularly to a light and compact vertical ram press for actuation of stationary cutoff dies and other devices.

BACKGROUND OF THE INVENTION

Cutoff systems for severing metal tubing, roll formed shapes and extruded workpieces typically comprise a clamping and shearing assembly called a cutoff die set. The die set often comprises upper and lower shoes or platens interconnected by guide pins and bushings for reciprocal motion. Actuation is typically accomplished by means of a mechanical press having a reciprocally driven ram.

Cutoff die sets can, of course, be actuated by means of hydraulically driven presses. However, hydraulic presses are typically very large and expensive, and a mechanical press is preferred. A relatively simple mechanically driven ram press having a substantially pure vertical ram motion might comprise a ram mounted on a vertical slide and being connected to a flywheel by means of an assembly of cranks. Although this is believed to be the most straightforward approach to the design of a compact vertical ram press, several disadvantages accrue from this particular design. First, there is sliding contact between metal surfaces over the entire stroke length of the press, creating a high wear situation. The wear is aggravated by the fact that the crank arm imposes a turning moment on the ram which can result in a chattering effect wherein the ram experiences slight angular displacements and subsequent corrections in a repeating fashion over the downward travel thereof. As a result, a slide ram press may consume more of the available drive energy in moving the ram up and down than it does in driving the die set and severing the workpiece.

A substantially superior press might be achieved by eliminating the vertical slide in favor of a more efficient radial bearing assembly. A press having a ram mounted on radial bearing or pivotal links is shown in U.S. Pat. No. 3,288,011 issued Nov. 29, 1966 to Alexander Borzym. That press comprises a long, relatively heavy ram mounted on parallelogram arms for a swinging oscillatory motion to accommodate substantial linear travel of the die set. This permits a so-called flying cut wherein the die set is accelerated up to the speed of a moving workpiece immediately prior to each cut. The substantial horizontal movement of the ram is a benefit in the flying cut in that it is in the direction of die set travel. Substantial horizontal ram movement would not be beneficial in the operation of a stationary die set.

The prior art relating to cutoff actuating presses does not teach the design of a compace lightweight press having a low inertia ram suitable for stationary die set actuation but which eliminates the disadvantages of hydraulic power and slide mounted rams.

BRIEF DESCRIPTION OF THE INVENTION

The present invention provides a compact, inexpensive mechanically driven press especially suitable for stationary die set actuation, having a low inertia, high speed ram supported so as to consume little power in ram actuation and to exhibit extremely low order wear characteristics. In general, this is accomplished by mounting a small, relatively light ram for substantially vertical travel on a pair of parallelogram arms having radial bearings within which the surface speed of relatively moving components is very low and exists only over a small angular range of displacement. The parallelogram arm mounting permits a full stroke press wherein the contact surface of the ram is maintained in a given plane at all times and in which the wobble or chattering effect of slide mounted rams is totally eliminated. Moreover, the parallelogram arm mount is of such length as to produce only a slight lateral component of displacement. In addition, the parallelogram mount minimizes the need for sliding surface contact between the ram and the die set thus further reducing wear and power consumption. Because the ram is low inertia and the bearing loads are so small the ram may be stopped quickly without overloading the brake and started quickly without overloading the clutch assembly of the mechanical drive.

Various additional features and advantages of the invention wil become apparent from a reading of the following specification in which a specific and illustrative embodiment of the invention is set forth in such full, clear and concise terms as to enable persons of ordinary skill in the mechanical arts of machine design and fabrication to construct and use the same.

DETAILED DESCRIPTION OF THE SPECIFIC EMBODIMENT

Figure 1:
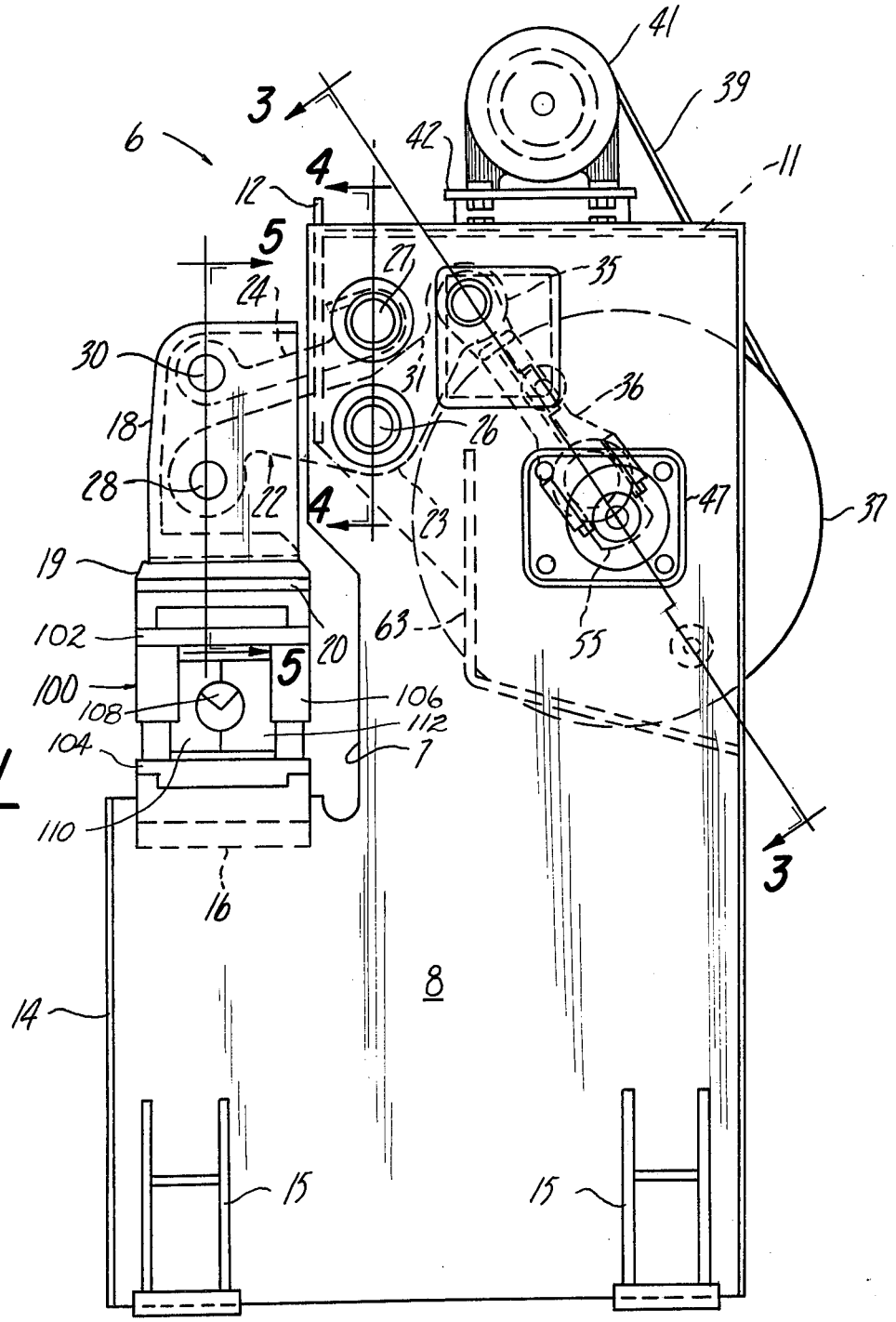
FIG. 1 is a side elevation view of a press.
Figure 2:
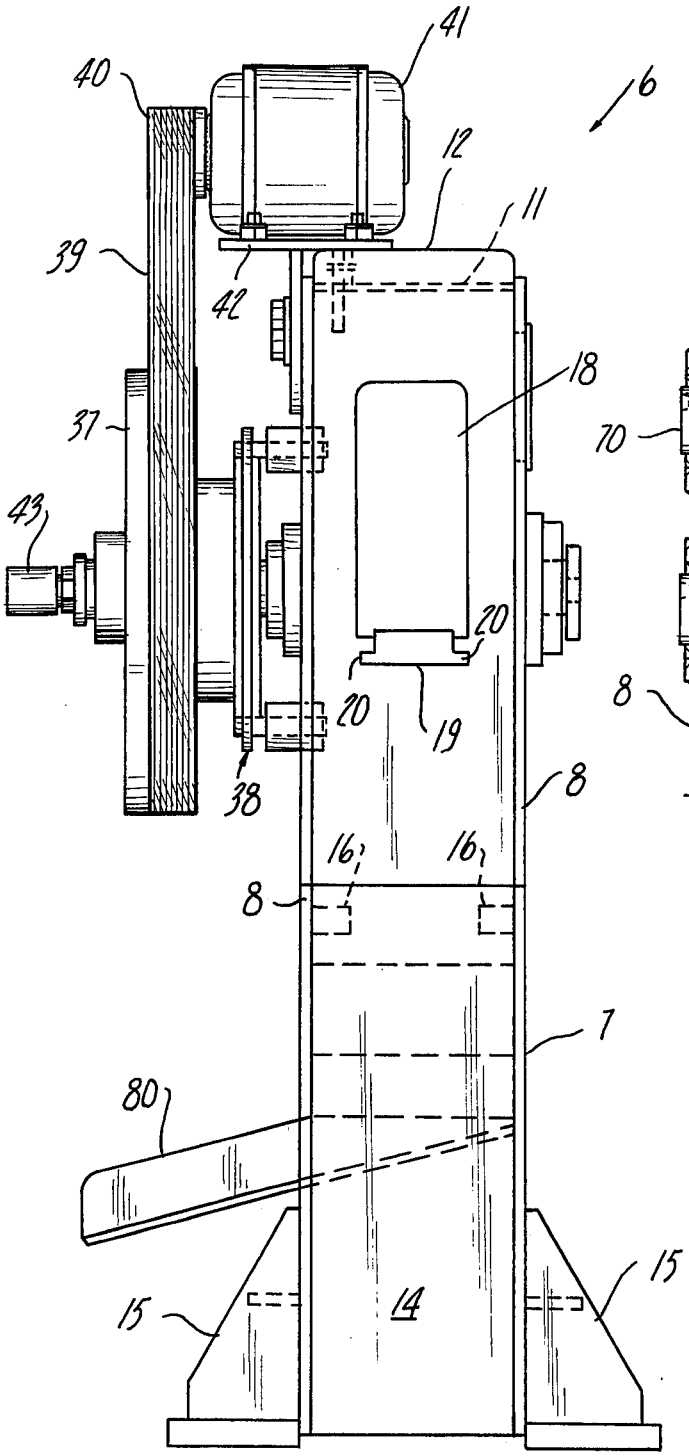
FIG. 2 is a front elevation view of the same.

The press 6 illustrated in FIGS. 1 and 2 includes a generally rectangular box-like frame 7 which is a structure welded from suitably shaped steel plates. The frame includes side plates 8, a top plate 11, an upper front plate 12, a lower front plate 14, and four supporting feet 15 welded to the side plates. The lower member of a single cut, stationary die set 100 is mounted on supports 16 fixed to the side plates. These supports lie beneath a ram 18 which is caused to reciprocate, oscillate, or stroke in a substantially pure vertical direction upon actuation of the press. The upper member of the die set is coupled to the ram through an upper die rail 19. This has flanges 20 which provide for a cross-head connection to the upper die member which is guided for vertical linear reciprocation on the lower die member, as is well understood in the art. Die sets suitable for use in the subject press are well known and may be purchased from Alpha Industries, Inc. of Detroit, Michigan.

The ram 18 is mounted for this generally vertical reciprocative displacement by a parallelogram linkage 22 which includes a rocker arm 23 and a swinging link 24. The rocker arm is mounted for oscillation on the frame on an axis at 26 and the link on a parallel axis at 27. The arm and link are coupled rotatably to the ram at axes 28 and 30 which are parallel to axes 26 and 27. The linkage is a parallelogram linkage because all of the axes lie at the vertices of a parallelogram. In other words, the distance between axes 27 and 30 is the same as that between axes 26 and 28 and the distance between axes 30 and 28 is the same as that between axes 27 and 26.

The arrangement of these axes and the bearings which support the rocker arm and link and connect them to the ram will be further described.

Figure 3:
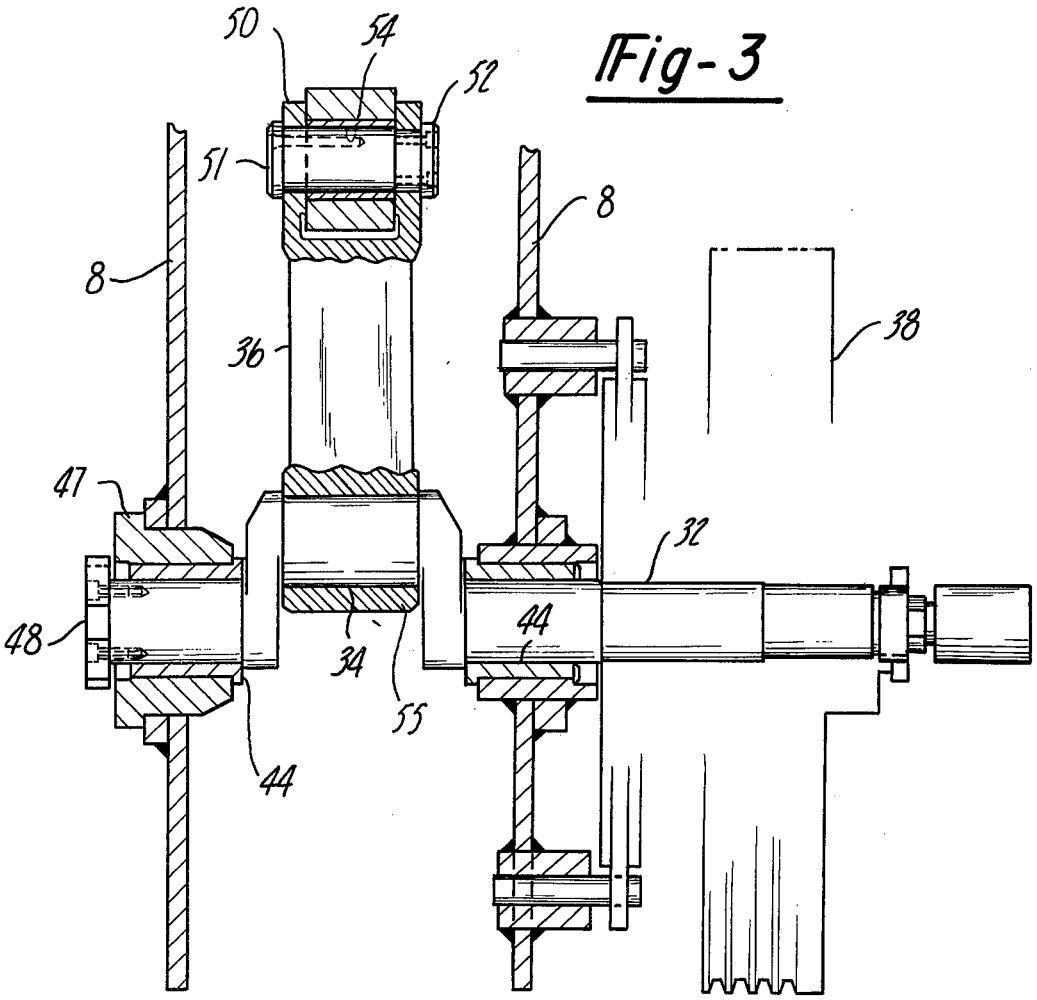
FIG. 3 is a detailed sectional view taken on the plane indicated by the line 3—3 in FIG. 1.

The rocker arm 23 includes an upwardly extending portion 31 by which it is coupled to a driving mechanism. This driving mechanism includes a power-driven crankshaft 32 (FIG. 3) having a single throw 34. This throw is connected to the rearward and upward end 35 of the rocker arm 23 by a connecting rod 36.

The crankshaft 32 is connected to a coaxial flywheel 37 through a suitable clutch and to the frame through a suitable brake. The clutch and brake 38 are operable in a conventional manner to engage the mechanical drive between the flywheel 37 and the crankshaft 32, and to stop the crankshaft 32, respectively. Accordingly, each full cycle of operation involves a downstroke and an upstroke, returning the ram to the top dead center position. A workpiece in die set 100 may thus be severed in a known manner. The flywheel 37 is driven by a belt or multiple V-belts 39 from a pulley 40 on the shaft of a suitable electric motor 41. The motor is mounted on the frame through a platform 42 which is adjustably supported by the frame 7 so that the tension of the belt may be adjusted. The crankshaft and bearings for it are lubricated through a suitable commercial rotary fitting 43. With this general introduction to the press ram driving mechanism we proceed to details of the driving mechanism. For this, we start with the crankshaft 32 and proceed through the structure to the ram 18.

The crankshaft 32 is rotatably supported in two radial bearings or bushings 44. One of these is pressed into a support welded to one side wall 8 and the other is mounted in a removable support plate 47 bolted to the other wall 8. The removable plate provides for introduction of the crankshaft into the frame. A timing gear 48 is bolted to the driven end of the crankshaft.

The connecting rod 36 is a suitable bronze casting having a clevised upper end 50 which is bored for a wrist pin 51. The wrist pin is retained by a washer 52 bolted to the smaller end of the pin. A bearing between the wrist pin 51 and the end 35 of the rocker arm is provided by a bushing 54. The lower end of the connecting rod 36 is coupled to the crank throw 34 by means of a bearing cap 55 bolted to the connecting rod 36. This structure provides for convenient assembly and disassembly of the connecting rod.

Figure 4:
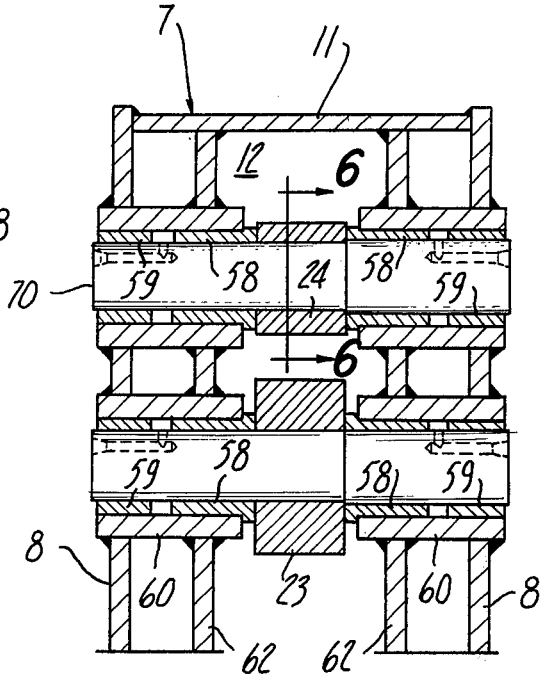
FIG. 4 is a detailed sectional view taken on the plane indicated by the line 4—4 in FIG. 1.

As previously stated, rocker arm 23 oscillates about an axis at 26. This axis is defined by a rocker arm shaft 56 (FIG. 4) rotatably mounted in inner bushings 58 and outer bushings 59 mounted in the frame 7. More specifically, these bushings are mounted in cylindrical supports 60 welded in openings in the side walls 8 and in inner walls 62 welded to the upper wall 11, the front wall 12, and an intermediate cross wall 63 (FIG. 1).

The link 24 is similarly supported for oscillation on a structure which may for convenience be exactly the same dimensionally as that for the rocker arm. The structure includes the shaft 70 and bushings 58 and 59 as previously described.

The end of link 24 which is mounted on shaft 70 is split as 71 and clamped to the shaft by screws 72. Shaft 56 is held in rocker arm 23 by a set screw (not illustrated) or otherwise.

Figure 5:
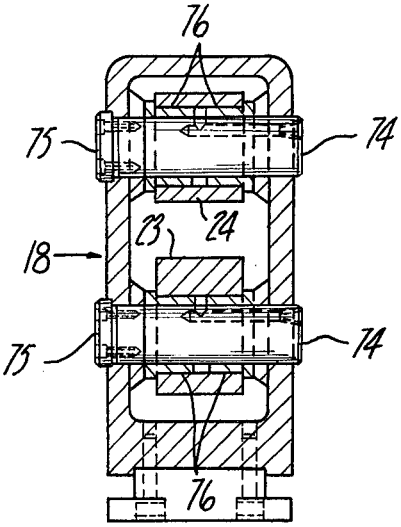
FIG. 5 is a detailed sectional view taken on the plane indicated by the line 5—5 in FIG. 1.
Figure 6:
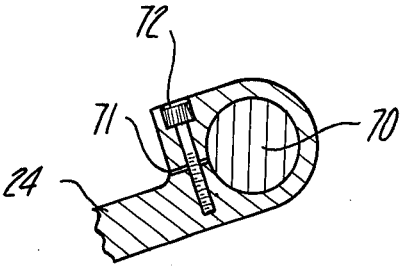
FIG. 6 is a fragmentary sectional view taken on the plane indicated by the line 6—6 in FIG. 4.

Proceeding now to FIG. 5, the ram 18 is a hollow cast box of high strength aluminum alloy (such as Almag 35). It is closed on all sides except that facing the front plate 12 of the frame. The rocker arm 23 and link 24 enter the ram through this face. The rocker arm and link are connected to the ram through preferably identical wrist pins 74 which have a step where they pass through one side of the ram and which are retained in place by caps 75 bolted to them. The wrist pins pass through flanged bushings or bearings 76 entering from opposite faces of the rocker arm and link, respectively. The link 24 may be of considerably lighter structure or smaller cross-section than the rocker arm 23, since the latter carries the driving force for the ram.

It is advantageous that crankshaft 32 and the clutch and brake for it are at a convenient height from the floor for access, about as high as the top of the die assembly, rather than on top of the machine as is conventional.

A chute 80 provides for discharge for scraps from the butting operation.

The press 6 is shown in operative combination with a die set 100 having upper and lower shoes 102 and 104 respectively connected by guide means 106 for relative reciprocative motion. Shoe 102 is counnected mechanically to the ram 18 so as to allow relative sliding motion perpendicular to the axis of the workpiece; i.e., in the plane of the paper. Shoe 102 carries a blade 108 which severs a workpiece held in clamping jaws 110 and 112 as the die set closes. Shoe 104 is connected to the bed 16. The sliding motion of ram 6 on shoe 102 is very slight and produces little wear on the sliding contact plates. Those skilled in the art will realize from the foregoing description that the invention makes possible a very compact press having a narrow frame and having light reciprocating rotating and oscillating parts. The use of radial bearings rather than slides contributes to a minimum of friction and length of life of the parts. Also, the lightweight structure tends to minimize energy requirements and to reduce to some extent the noise of operation of the machine.

The parallelogram linkage results in very low bearing speed and low friction, and the radial bearings are relatively easy to replace. The radial bearings can have smaller clearances and thus be more accurate in operation than slide bearings. The accuracy of the press is maintained for a longer time period than with slide bearings.

It is to be understood that the invention has been described with reference to specific illustrative embodiments and that the foregoing description is not to be construed in a limiting sense.

The embodiments of the invention in whcih an exclusive property or privilege is claimed are defined as follows:

1. A press comprising, in combination, a rigid frame including a portion adapted to support a first member of a die set; a ram adapted to support a second member of the die set and traverse the second member relative to the first member; a parallelogram linkage connecting the ram to the frame including a link and a rocker arm pivotally connected to the frame for rotation about first and second axes and pivotally connected directly to the ram at third and fourth axes, the said four axes being parallel and passing through the vertices of a parallelogram; a power-driven crankshaft rotatably mounted on the frame including a crank throw; and a connecting rod coupling the crank throw to the rocker arm so that the rocker arm and link are oscillated upon rotation of the crankshaft to move the ram and second die member.

2. A press as recited in claim 1 in which the rocker arm connection to the frame is between the ram and the connecting rod.

3. A press as recited in claim 1 in which the crankshaft is at approximately the same distance from the base of the frame as the portion of the ram nearest the base.

4. In combination: a die set actuable by a reciprocating press ram for severing elongate workpieces into selected lengths, said die set comprising relatively movable upper and lower shoes interconnected by guide means, and a blade carried by the upper shoe for severing said workpieces; a press for actuating the die set and comprising a rigid frame including a portion adapted to support a first member of a die set; a ram adapted to support a second member of the die set and tranverse the second member relative to the first member; a parallelogram linkage connecting the ram to the frame including a link and a rocker arm pivotally connected to the frame for rotation about first and second axes and pivotally connected directly to the ram at third and fourth axes, the said four axes being parallel and passing through the vertices of a parallelogram; a power-driven crankshaft rotatably mounted on the frame including a crank throw; and a connecting rod coupling the crank throw to the rocker arm so that the rocker arm and link are oscillated upon rotation of the crankshaft to move the ram and second die member; and means mechanically connecting said press ram to the upper shoe to reciprocate said upper shoe relative to the frame and the lower shoe, the orientation of said workpiece being substantially parallel to the axes of rotation of said linkage, said means for connecting including means to permit limited relative sliding motion between said ram and upper shoe along a plane perpendicular to the workpiece axis.

* * * * *